US011310604B2

(12) United States Patent
Cho et al.

(10) Patent No.: US 11,310,604 B2
(45) **Date of Patent: *Apr. 19, 2022**

(54) FLAT SPEAKER DRIVEN BY A SINGLE PERMANENT MAGNET AND ONE OR MORE VOICE COILS

(71) Applicant: Resonado, Inc., South Bend, IN (US)

(72) Inventors: Leeg Hyun Cho, Yongin-si (KR); Darrell Seyler Adams, Dripping Springs, TX (US); Youngil Cho, Chicago, IL (US)

(73) Assignee: Resonado, Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/143,088

(22) Filed: Jan. 6, 2021

(65) Prior Publication Data

US 2022/0070589 A1 Mar. 3, 2022

Related U.S. Application Data

(60) Provisional application No. 63/070,748, filed on Aug. 26, 2020.

(51) Int. Cl.

| | |
|---|---|
| ***H04R 9/06*** | (2006.01) |
| ***H04R 9/04*** | (2006.01) |
| ***H04R 9/02*** | (2006.01) |
| ***H04R 7/16*** | (2006.01) |

(52) U.S. Cl.
CPC ..... *H04R 9/06* (2013.01); *H04R 7/16* (2013.01); *H04R 9/027* (2013.01); *H04R 9/045* (2013.01)

(58) Field of Classification Search
CPC . H04R 9/06; H04R 7/16; H04R 9/027; H04R 9/045
See application file for complete search history.

(56) References Cited

U.S. PATENT DOCUMENTS

| | | | | |
|---|---|---|---|---|
| 2,554,859 A | | 5/1951 | Hoekstra | |
| 5,740,265 A | * | 4/1998 | Shirakawa | H04R 9/025 381/386 |
| 10,743,097 B1 | | 8/2020 | Cho | |
| 2004/0086150 A1 | * | 5/2004 | Stiles | H04R 9/025 381/421 |
| 2005/0089187 A1 | * | 4/2005 | Turnmire | H04R 7/125 381/396 |
| 2007/0140520 A1 | * | 6/2007 | Konuma | H04R 9/045 381/400 |
| 2007/0189577 A1 | | 8/2007 | Tsuda | |
| 2014/0219494 A1 | | 8/2014 | Kim | |
| 2016/0205479 A1 | | 7/2016 | Tomar | |

* cited by examiner

*Primary Examiner* — Sunita Joshi
(74) *Attorney, Agent, or Firm* — DLA Piper LLP (US)

(57) ABSTRACT

Embodiments are disclosed of a flat speaker containing a single permanent magnet, a yoke opposite the single permanent magnet, and one or more voice coil plates located between the single permanent magnet and the yoke. The one or more voice coil plates each comprise a bobbin and a coil arranged on one or both sides of the bobbin.

22 Claims, 18 Drawing Sheets

FLAT SPEAKER DRIVEN BY A SINGLE PERMANENT MAGNET AND ONE OR MORE VOICE COILS

PRIORITY CLAIM

This application claims priority to U.S. Provisional Patent Application No. 63/070,748, filed on Aug. 26, 2020, and titled, "Single Magnet Speaker," which is incorporated by reference herein.

TECHNICAL FIELD

Embodiments are disclosed of a flat speaker containing a single permanent magnet, a yoke opposite the single permanent magnet, and one or more voice coil plates located between the single permanent magnet and the yoke.

BACKGROUND OF THE INVENTION

A schematic illustration of commonly-used, prior art cone-type speaker 100 is shown in FIG. 1. Cone-type speaker 100 usually has a cylindrical shape and uses a cylindrical permanent magnet 110. Cone-type speaker 100 also comprises voice coil 111, diaphragm 112, basket/frame 113, and damper 114. Notably, because diaphragm 112 is cone-shaped, it has a significant height, which sets a limit on how thin the overall speaker structure can be. In addition, T-yoke 115 also has a significant height and sets a limit on how thin the overall speaker structure can be.

Moreover, the use of cylindrical magnet 110 forces the frame to adopt a closed-cone-shaped structure, which is, for practical consideration, limited from having multiple diaphragms driven by the same voice coil. The prior art also includes coaxial speakers, where multiple cone-shaped speakers are contained within a common structure, such as a tweeter being embedded within a woofer, but in those instances each speaker is driven by a separate voice coil and magnetic structure, and not the same voice coil and magnetic structure. Thus, in the prior art, the only multi-frequency range speakers that exist contain two separate speakers (with two diaphragms each driven by a separate voice coil and magnet) combined into one structure, which results in a more complicated structure and additional size and weight in the design.

Furthermore, in order to support the recent development of three-dimensional surround sound systems or other varieties of different sound reproduction that the industry requires, the speaker must be able to reproduce a broad range of sound signal with low distortion. The physical size of each diaphragm inherently limits the frequency range of sound that the diaphragm can produce effectively. A relatively small diaphragm is unable to reproduce low-frequency sound efficiently because the wavelength of the sound is larger than the diaphragm itself. On other hand, a relatively large diaphragm primarily designed to reproduce low-frequency sound may be ill-suited for reproducing high-frequency sound because larger prior art cone-shaped diaphragms often are not stiff enough to reproduce high-frequency sound without the occurrence of diaphragm breakup and modal behavior, resulting in significant distortion. The prior art lacks an efficient speaker structure that addresses both the spatial constraints and the requirement for a wide frequency range of sound. One prior art solution is to use multiple speakers of different frequency ranges set a certain distance apart from one another, but this method results in occupying an unnecessarily large space. Therefore, there exists a need for an improved speaker that can effectively reproduce a wide range of frequencies of sound but occupies less space than prior art speakers.

SUMMARY OF THE INVENTION

Embodiments are disclosed of a flat speaker containing a single permanent magnet, a yoke opposite the single permanent magnet, and one or more voice coil plates located between the single permanent magnet and the yoke. The one or more voice coil plates each comprise a bobbin and a coil arranged on one or both sides of the bobbin.

BRIEF DESCRIPTION OF THE DRAWINGS

Exemplary embodiments of the present invention are described with reference to the accompanying drawings, in which.

DETAILED DESCRIPTION OF THE PREFERRED EMBODIMENT

Features and advantages of the present invention described above will become apparent from the following descriptions in conjunction with the accompanying drawings. According to the descriptions, a person with the proper technical expertise will be able to execute the technical idea illustrated in this present invention in the relevant industry. Since this invention can have a variety of different applications and may take different forms and shapes, only specific examples are illustrated through Figures and the detailed descriptions are found in the main text. However, this is by no means to restrict the present invention to the particular form disclosed; its derivations, equivalents, and substitutes must be understood as embracing all included in the scope of the present invention. The terms used herein are merely used to describe particular examples and are not intended to limit the present invention.

Figure 1:
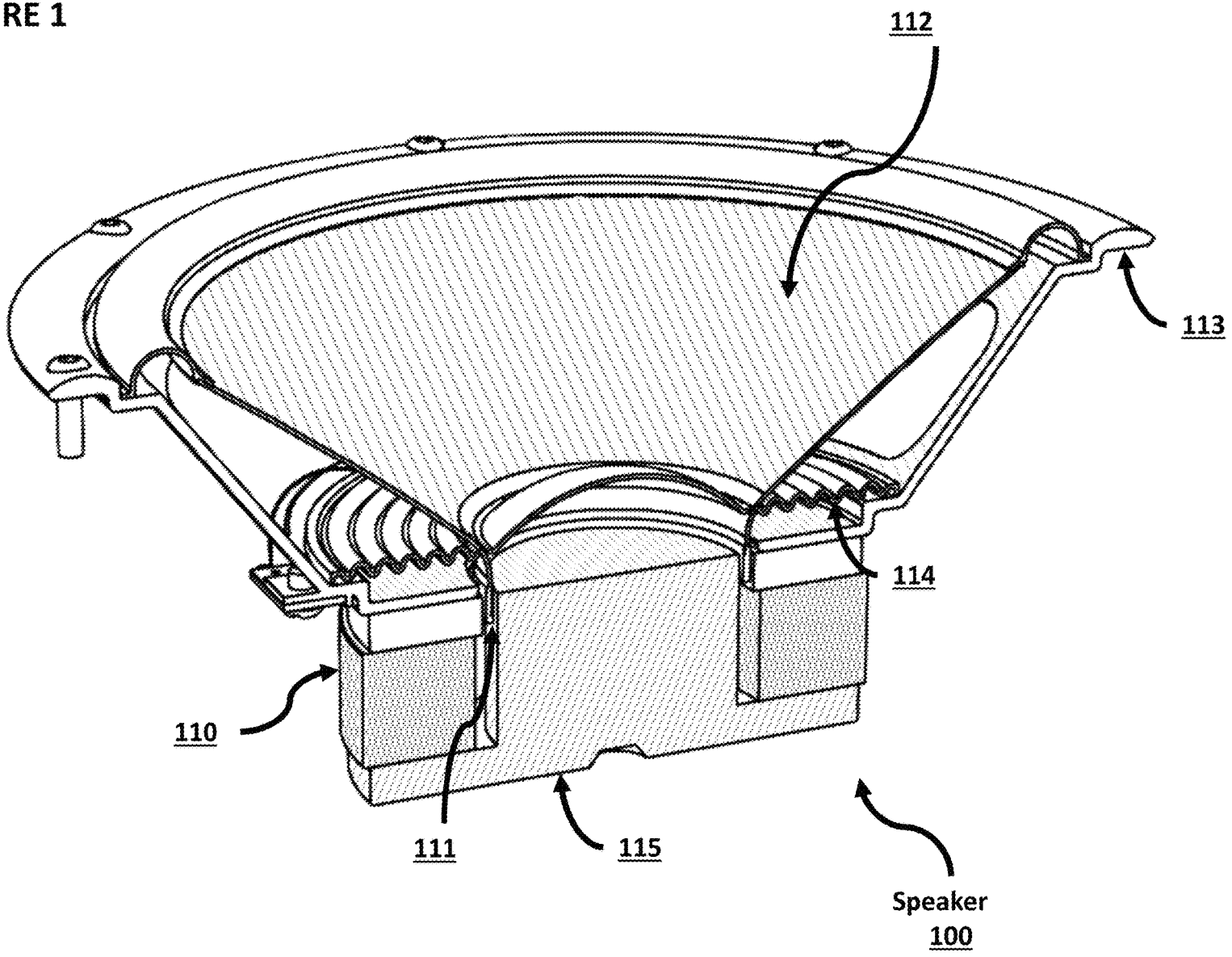
FIG. 1 depicts a conventional speaker with a cone-shaped structure.
Figure 2A:
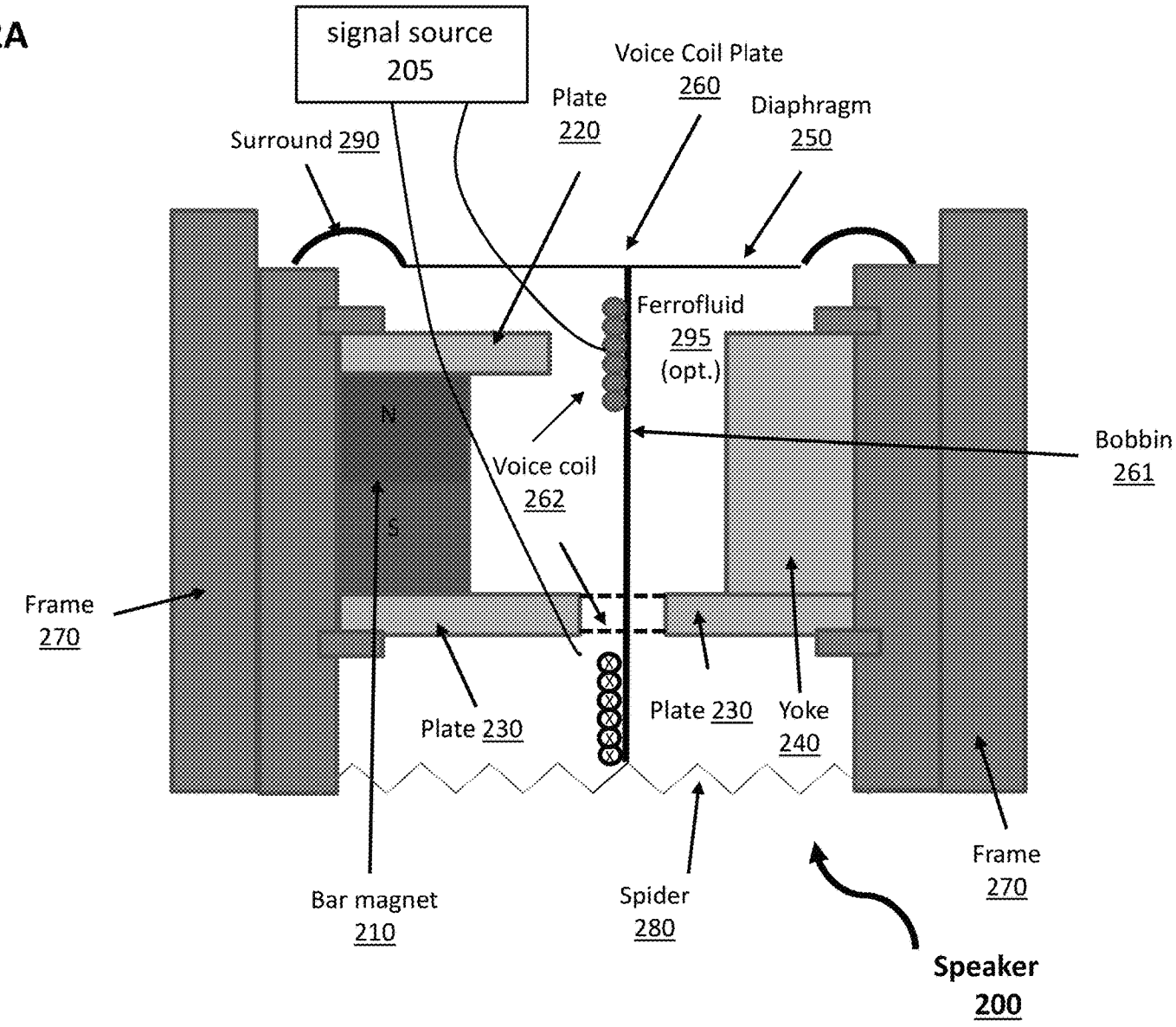
FIG. 2A depicts a side view of an embodiment of a speaker.

FIG. 2A depicts a side view of a speaker design utilizing a single diaphragm and a single bar magnet. Speaker 200 comprises bar magnet 210, upper plate 220, lower plate 230, yoke 240, diaphragm 250, and voice coil plate 260. Voice coil plate 260 comprises bobbin 261 and voice coil 262. Speaker 200 further comprises speaker frame 270. Bar magnet 210 has a north polarity and a south polarity. On one end, voice coil plate 260 is secured to speaker frame 270 through diaphragm 250 and surround material 290, and on the other end, voice coil plate 260 is secured to speaker frame 270 through spider 280 or through a second diaphragm (not shown). Surround material 290 comprises a flexible material such as rubber. Speaker is driven by signal source 205, described in greater detail below. The dotted lines in plate 230 indicate that plate 230 is a single piece although it appears to be two pieces in this particular cross-section. For example, plate 230 can be in the shape of an elongated donut.

Optionally, the gap surrounding voice coil plate 260 is filled with ferrofluid 295. In one embodiment, ferrofluid 295 comprises iron particles suspended in a liquid carrier. Ferrofluid 295 can help center voice coil plate 260 in the gap and serve as a liquid buffer so that it does not rub up against yoke 240, plates 220 or 230, or bar magnet 210, which can cause excess noise and distortion. Ferrofluid 295 also can help fine tune the mechanical damping of the driver depending on the viscosity of the fluid and can increase thermal conductivity of the driver, thereby increasing power rating and decreasing thermal compression that can happen to the sound.

Upper plate 220 is attached to the upper part of bar magnet 210, and lower plate 230 is attached to the lower part of bar magnet 210. Upper plate 220 and lower plate 230 operate as a yoke, which along with yoke 240, contain and direct the magnetic field in the area between the magnet where the voice coil plate 260 resides. Upper plate 220 and lower plate 230 optionally may extend beyond bar magnet 210 into the magnetic gap to increase the magnetic flux density induced in the magnetic gap.

Diaphragm 250 is positioned above upper plate 220, but also could be placed below lower plate 230 instead. Diaphragm 250 must be configured to produce the corresponding frequency range sound accordingly with the size of diaphragm 250. In this embodiment, diaphragm 250 is substantially flat. However, diaphragm 250 instead could be convex or concave, or any shape with respect to the top surface of the frame designed for any application-related acoustic design.

Figure 2C:
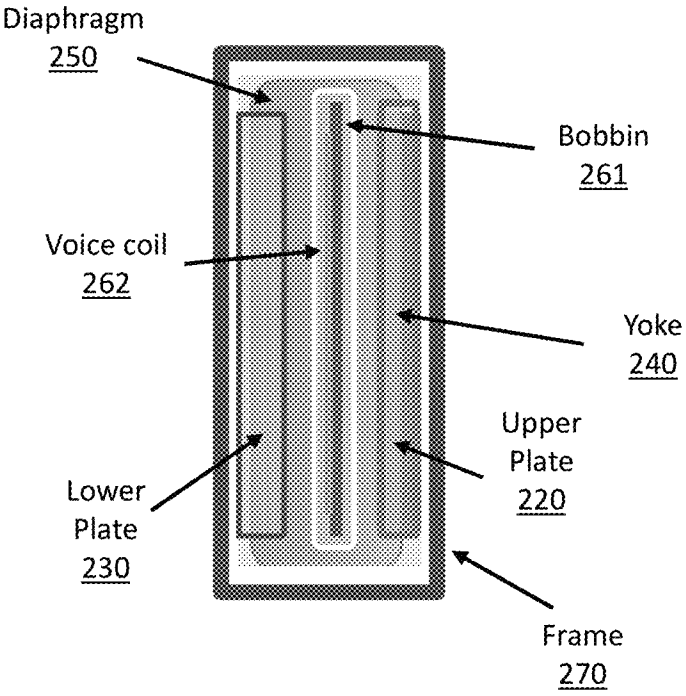
FIG. 2C depicts a top view of various components of the speaker of FIG. 2A.
Figure 2B:
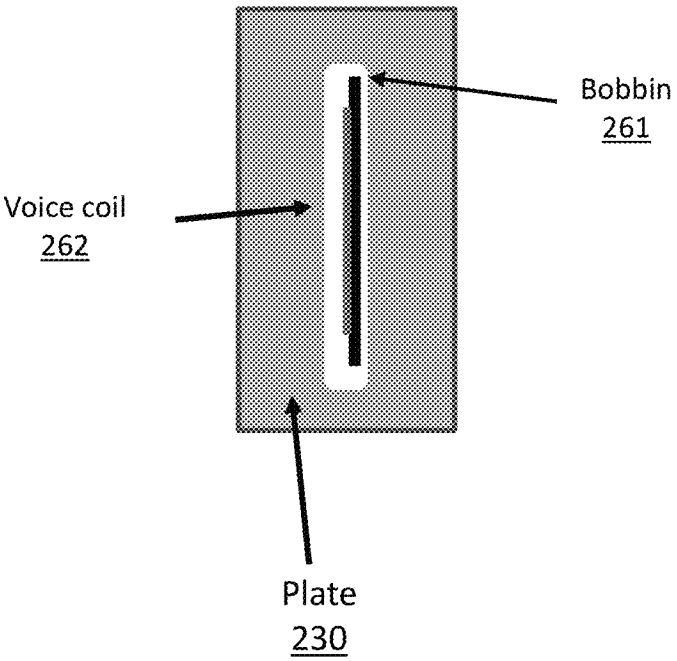
FIG. 2B depicts a top view of various components of the speaker of FIG. 2A.

FIG. 2B depicts a cross-section top view of lower plate 230, bobbin 261, and voice coil 262.

FIG. 2C depicts a cross-section top view of diaphragm 250, voice coil 262, lower plate 230, upper plate 220, frame 270, yoke 240, and bobbin 261.

FIGS. 3A, 3B, 3C, and 3D demonstrate the operation method of speaker 200 and other speakers discussed below. With reference to speaker 200, voice coil plate 260 must be positioned in a substantially rigid, planar form in the gap between bar magnet 210 and yoke 240. Coil 262 can be placed on one side of bobbin 261 or on both sides. Diaphragm 250 will be vibrated at a specific frequency range by the magnetic field induced by bar magnet 210 and the electric current flowing in the voice coil 262.

Figure 3A:
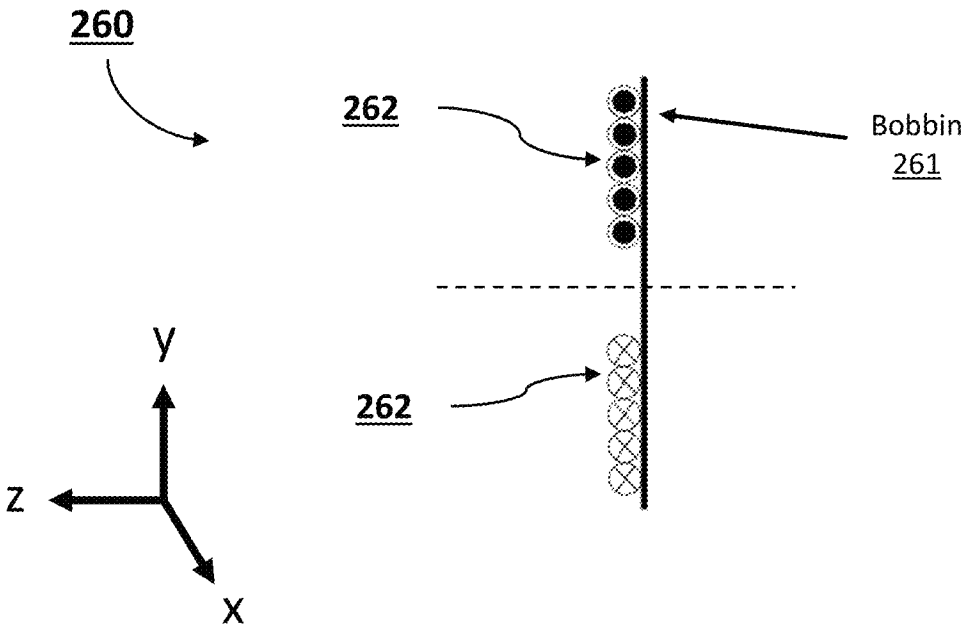
FIG. 3A depicts a voice coil plate.

In FIG. 3A, the dark circles in coil 262 indicate current flowing "out of the page," and the circles with X's indicate current flowing "into the page."

Figure 3B:
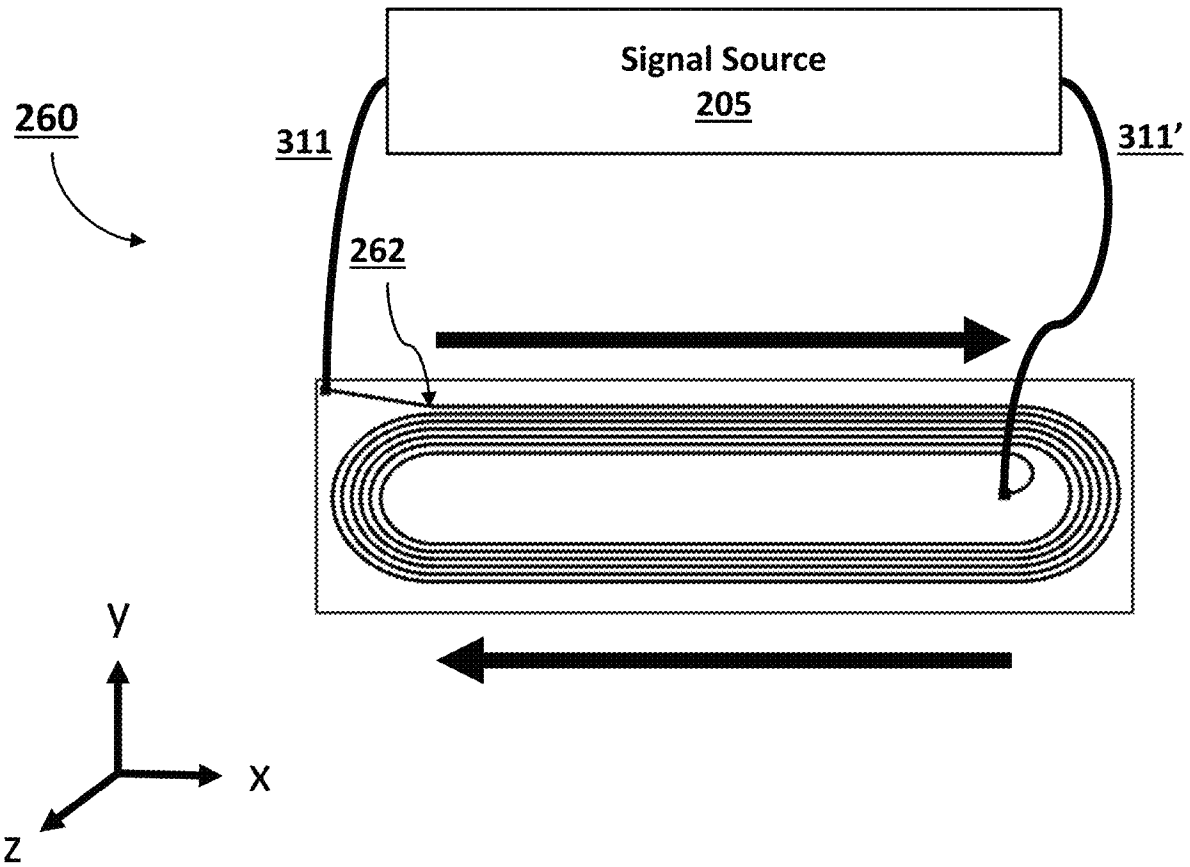
FIG. 3B depicts a voice coil plate of FIG. 3A driven by a signal source.

In FIG. 3B, during operation, coil 262 receives an electrical audio signal from a signal source 205 over conductors 311 and 311'. A magnetic field is induced by bar magnet 210, generally in the direction from the north poles (N) to the south poles (S). During the first half of the signal cycle (defined as the "positive half-cycle"), current flows through coil 262 as shown in FIG. 3A. This direction of current flow is shown from a different point of view in FIG. 3B. When the voice coil plate 260 is installed in the context of FIG. 2, Lorentz forces are generated by coil 262 interacting with the magnetic field generated by bar magnet 210, which pushes voice coil plate 260 upward, which pushes diaphragm 250 upward according to the magnitude of the electrical signal from the signal source.

Figure 3C:
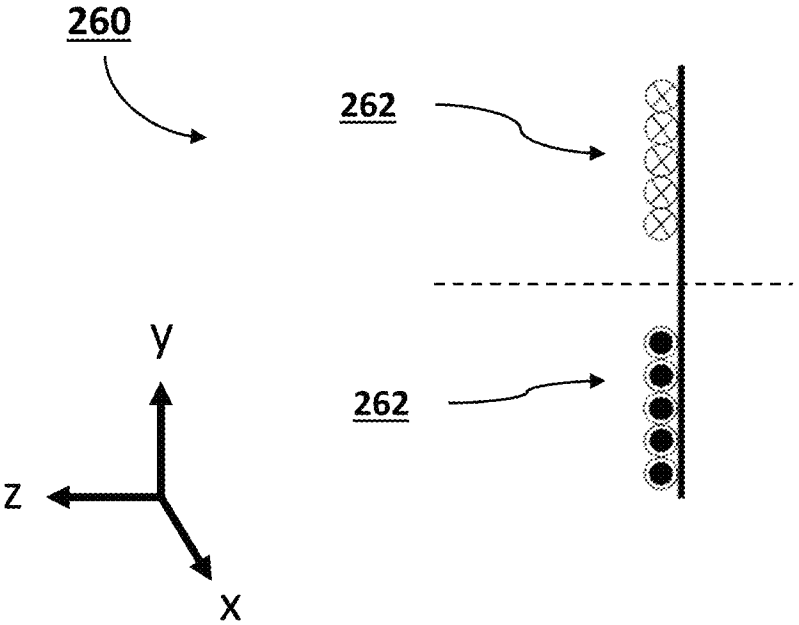
FIG. 3C depicts the voice coil plate of FIG. 3A with the current direction reversed compared to FIG. 3A
Figure 3D:
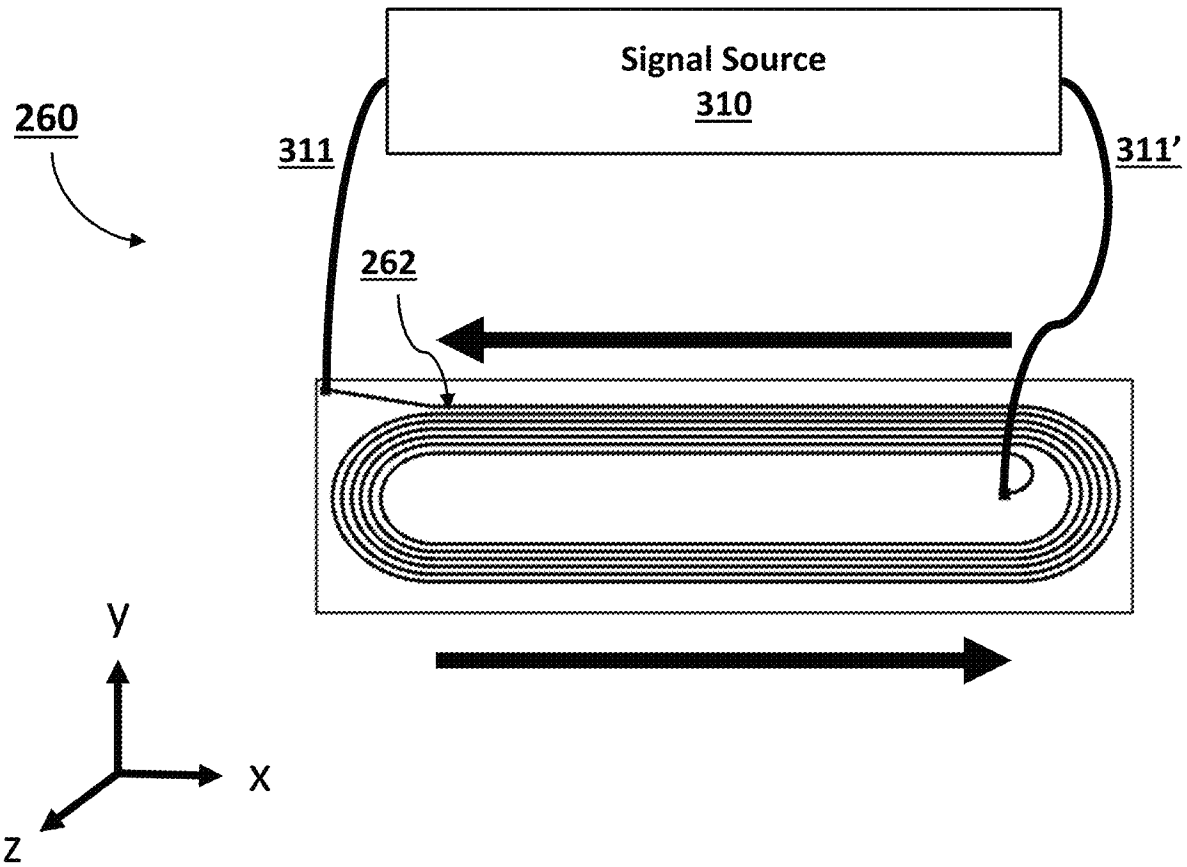
FIG. 3D depicts the voice coil plate of FIG. 3A driven by a signal source with the current direction reversed compared to FIG. 3A

With reference to FIG. 3C, during the second half of the signal cycle (defined as the "negative half-cycle"), current flows in the opposite direction. With reference to FIG. 3D, since the direction of the current in coil 262 is reversed, then the Lorentz forces from the interaction with the magnetic field generated by bar magnet 210 will push voice coil plate 260 downward, which pulls diaphragm 250 downward according to the magnitude of the electrical signal from the signal source.

Figure 4A:
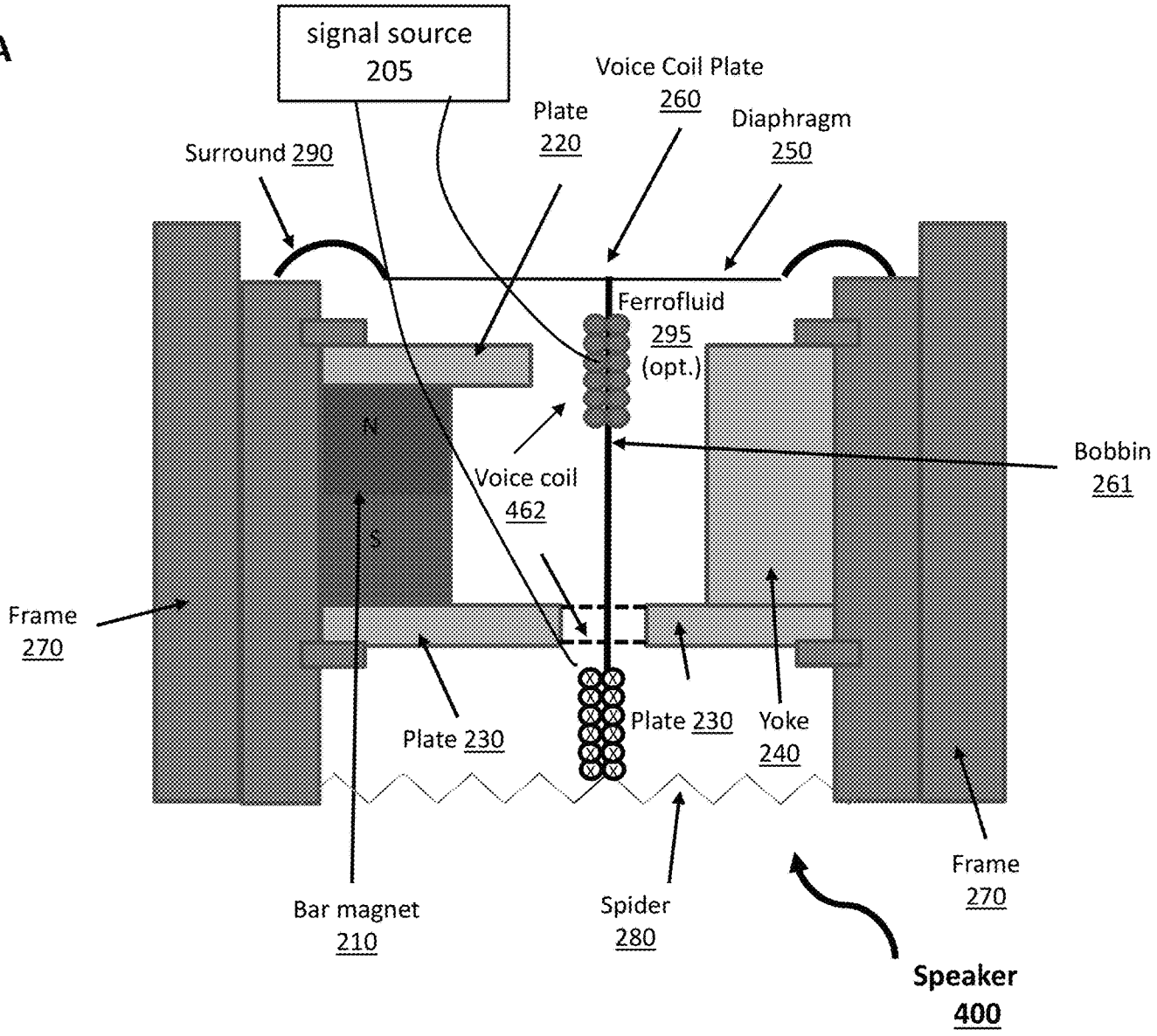
FIG. 4A depicts a side view of another embodiment of a speaker.
Figure 4C:
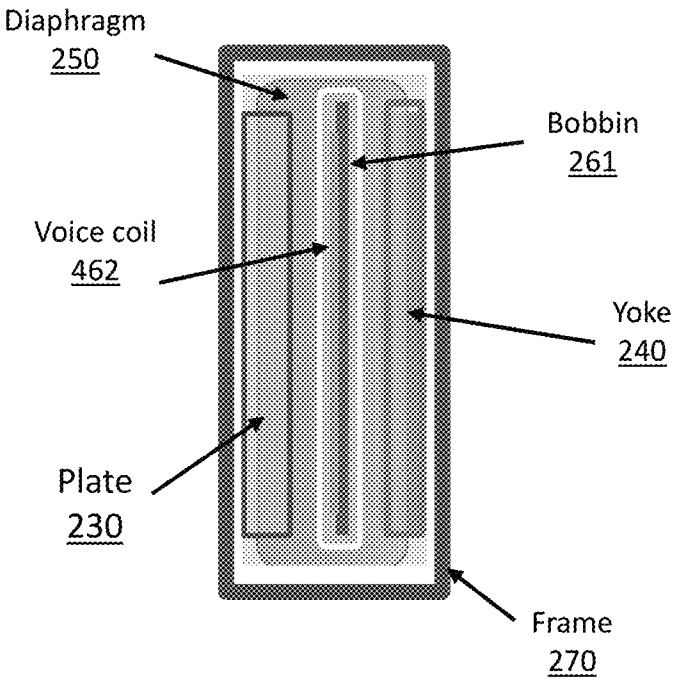
FIG. 4C depicts a top view of various components of the speaker of FIG. 4A.
Figure 4B:
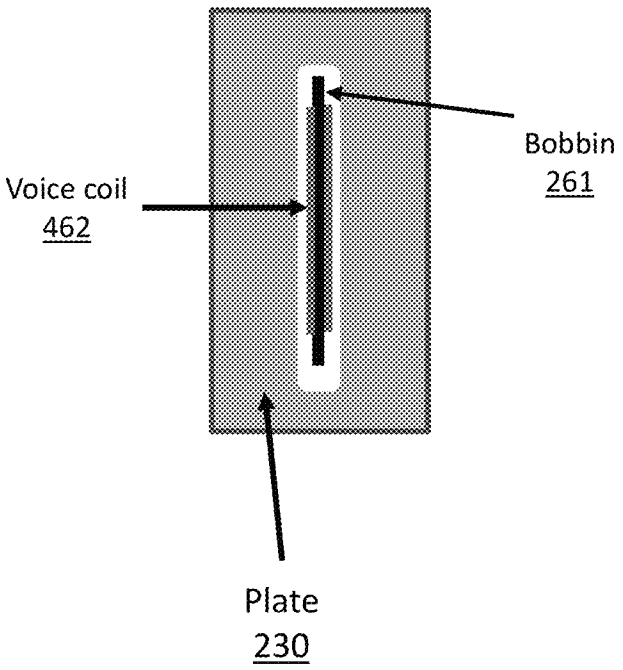
FIG. 4B depicts a top view of various components of the speaker of FIG. 4A.

FIGS. 4A, 4B, and 4C depict speaker 400. Speaker 400 is identical to speaker 200 in FIGS. 2A, 2B, and 2C except that voice coil 462 is wound on both sides of bobbin 261 instead of on only one side. Speaker 400 is driven by signal source 205. The Lorentz forces are generated in speaker 400 in the same manner described previously for speaker 200 with reference to FIGS. 3A-3D.

Figure 5A:
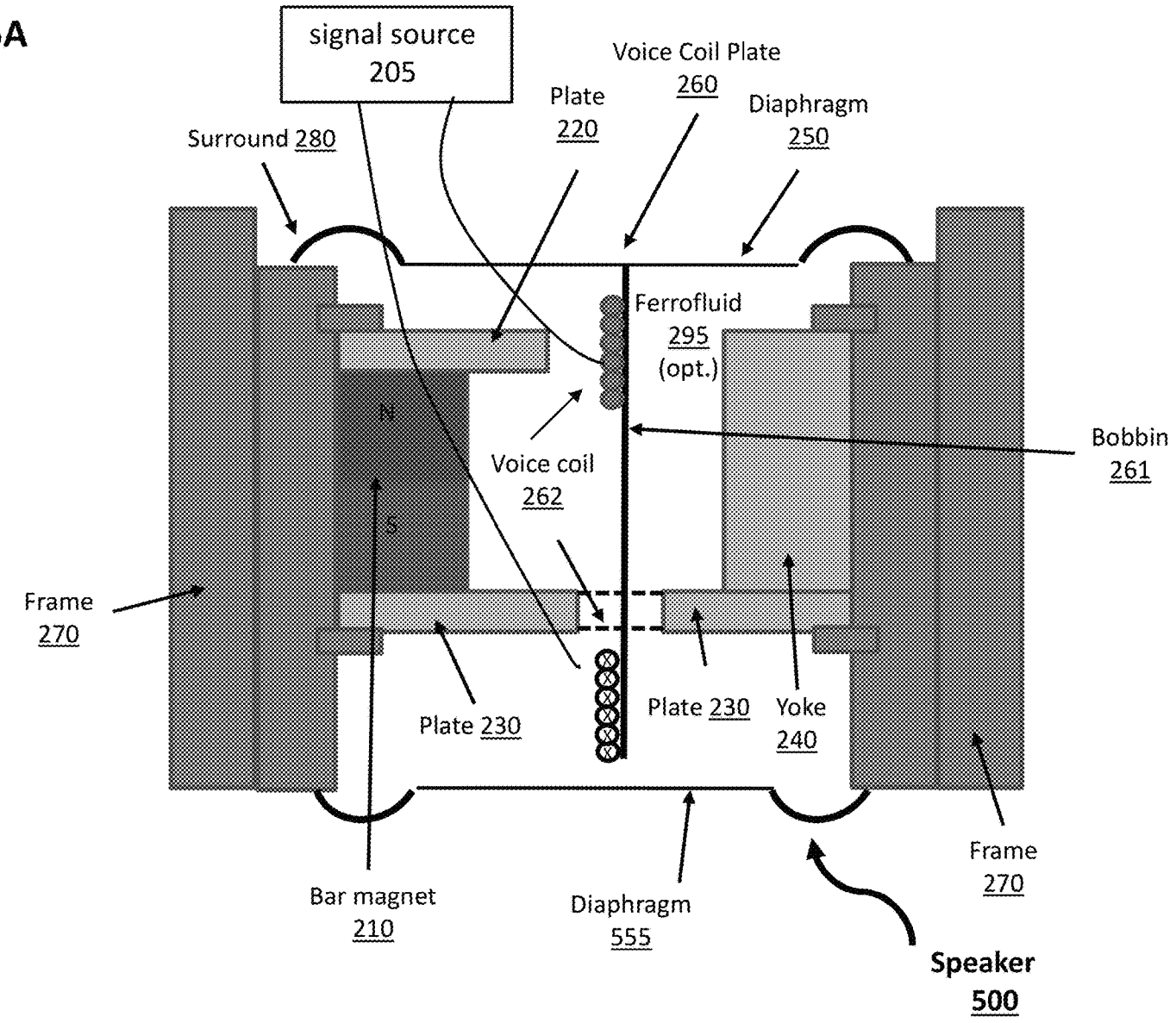
FIG. 5A depicts a side view of another embodiment of a speaker.
Figure 5C:
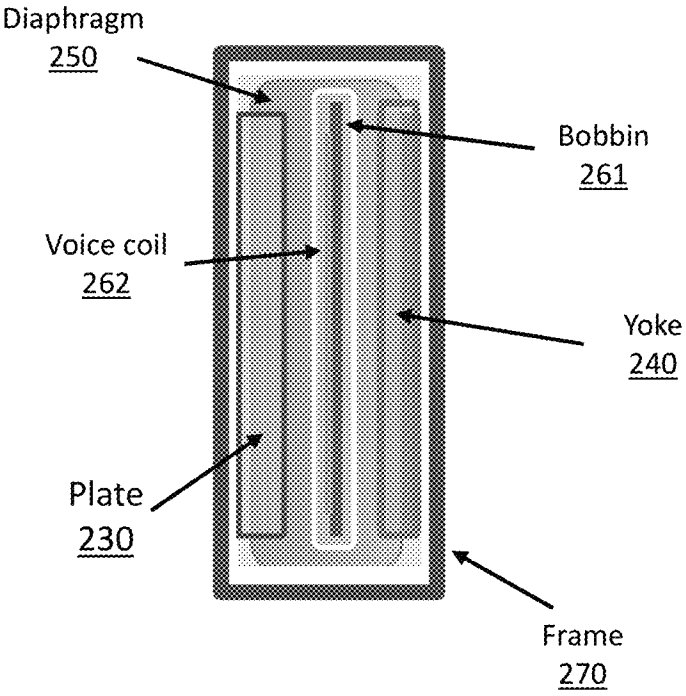
FIG. 5C depicts a top view of various components of the speaker of FIG. 5A.
Figure 5B:
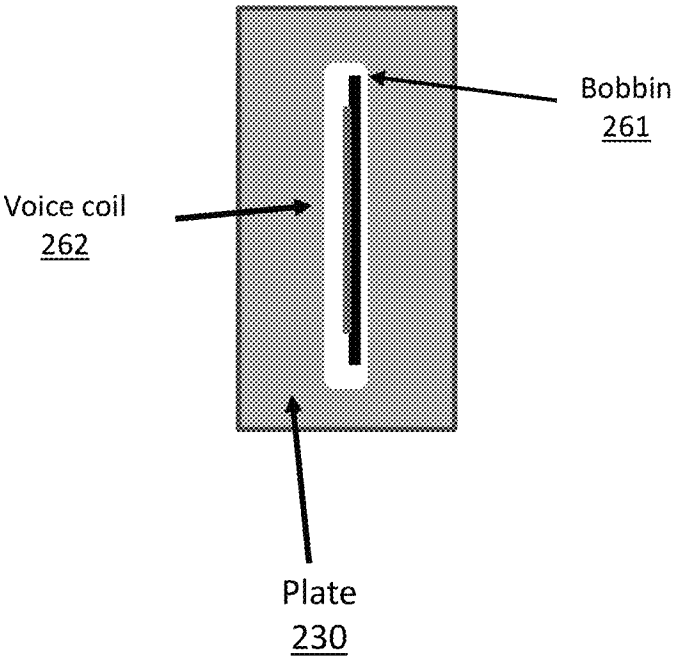
FIG. 5B depicts a top view of various components of the speaker of FIG. 5A.

FIGS. 5A, 5B, and 5C depict speaker 500. Speaker 500 is identical to speaker 200 in FIGS. 2A, 2B, and 2C except that spider 280 is replaced with diaphragm 555. Speaker 500 is driven by signal source 205. The Lorentz forces are generated in speaker 500 in the same manner described previously for speaker 200 with reference to FIGS. 3A-3D. A person of ordinary skill in the art will appreciate that the same modification could be made to speaker 400 (i.e., spider 280 can be replaced with diaphragm 555).

Figure 6A:
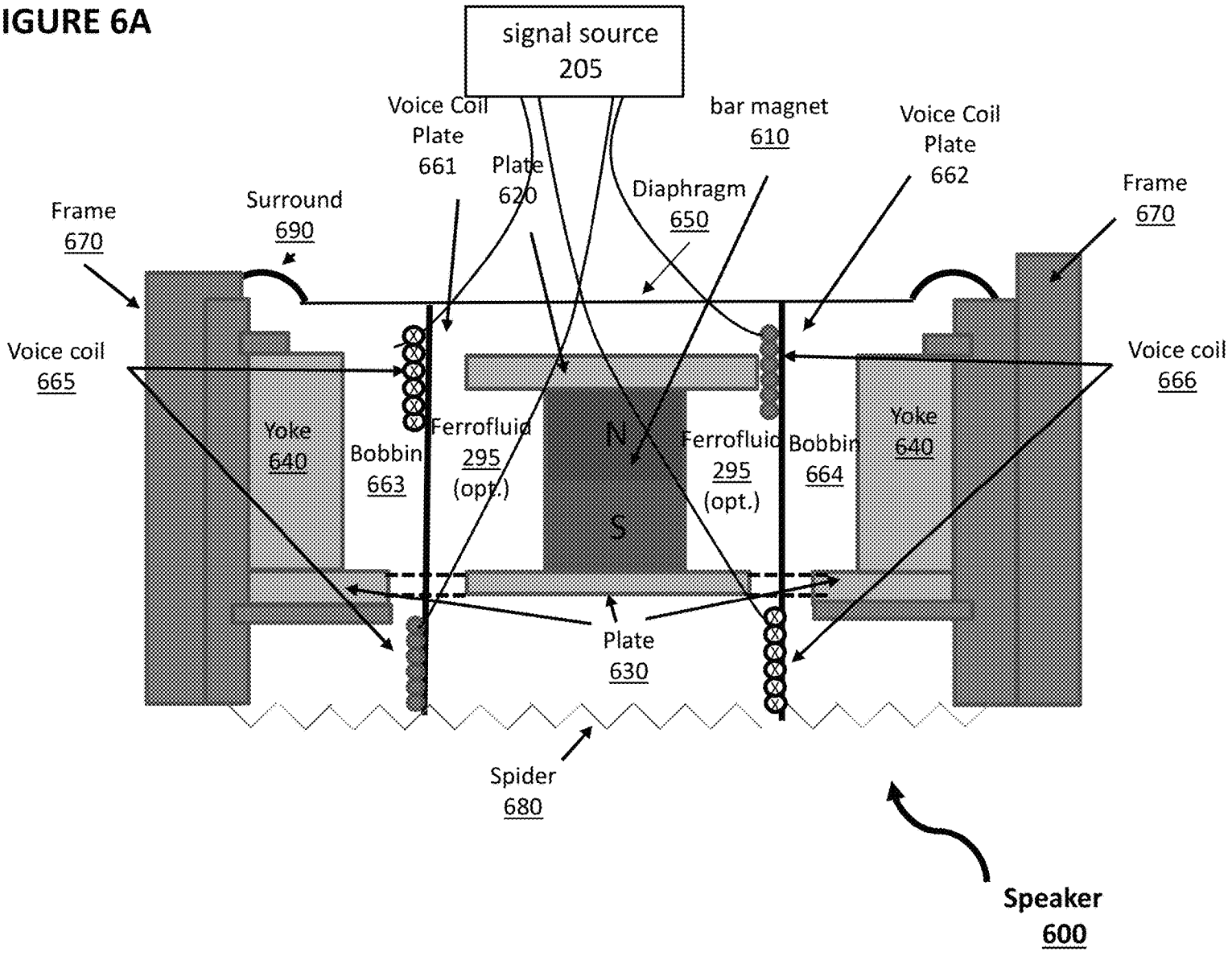
FIG. 6A depicts a side view of another embodiment of a speaker.

FIG. 6A depicts a side view of a speaker design utilizing a single diaphragm, a single bar magnet, and two voice coil plates. Speaker 600 comprises bar magnet 610, upper plate 620, lower plate 630, yoke 640, diaphragm 650, and voice coil plates 661 and 662. Voice coil plate 661 comprises bobbin 663 and voice coil 665. Voice coil plate 662 comprises bobbin 664 and voice coil 666. Speaker 600 further comprises speaker frame 670. Bar magnet 610 has a north polarity and a south polarity. On one end, voice coil plates 661 and 662 are each secured to speaker frame 670 through diaphragm 650 and surround material 690, and on the other end, voice coil plates 661 and 662 are each secured to speaker frame 670 through spider 680 or through a second diaphragm (not shown).

Upper plate 620 is attached to the upper part of bar magnet 610, and lower plate 630 is attached to the lower part of bar magnet 610. Upper plate 620 and lower plate 630 operate in tandem with yoke 640 to contain and direct the magnetic field in the area between the magnet and the yoke where the voice coil plates 661 and 662 reside. Upper plate 620 and lower plate 630 optionally may extend beyond bar magnet 610 into the magnetic gap to increase the magnetic flux density induced in the magnetic gap. Voice coil 665 and voice coil 666 are each driven, electrically out of phase, by a single signal source 205 so that current in the top of coil 665 runs in the opposite direction of the top of coil 666, and the current in the bottom of voice coil 665 runs in the opposite direction as the current in the bottom of coil 666. This provides mechanical movement of voice coil plates 661 and 662 in the same direction so that each coil plate can drive diaphragm 650 in tandem.

Diaphragm 650 is positioned either above upper plate 620 or below lower plate 630. In this case, diaphragm 650 must be configured to produce the corresponding frequency range sound accordingly with the size of diaphragm 650. In this embodiment, diaphragm 650 is substantially flat. However, diaphragm 650 instead could be convex or concave, or any shape with respect to the top surface of the frame designed for any application-related acoustic design.

Optionally, the gaps surrounding voice coil plates 661 and 662 are filled with ferrofluid 295.

Figure 6B:
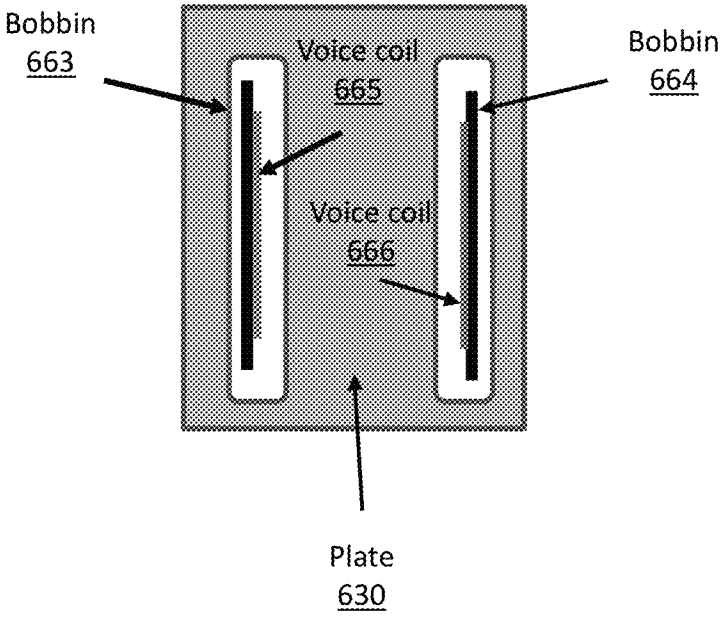
FIG. 6B depicts a top view of various components of the speaker of FIG. 6A

FIG. 6B depicts a cross-section top view of lower plate 630, bobbins 663 and 664, and voice coils 665 and 666.

Figure 7A:
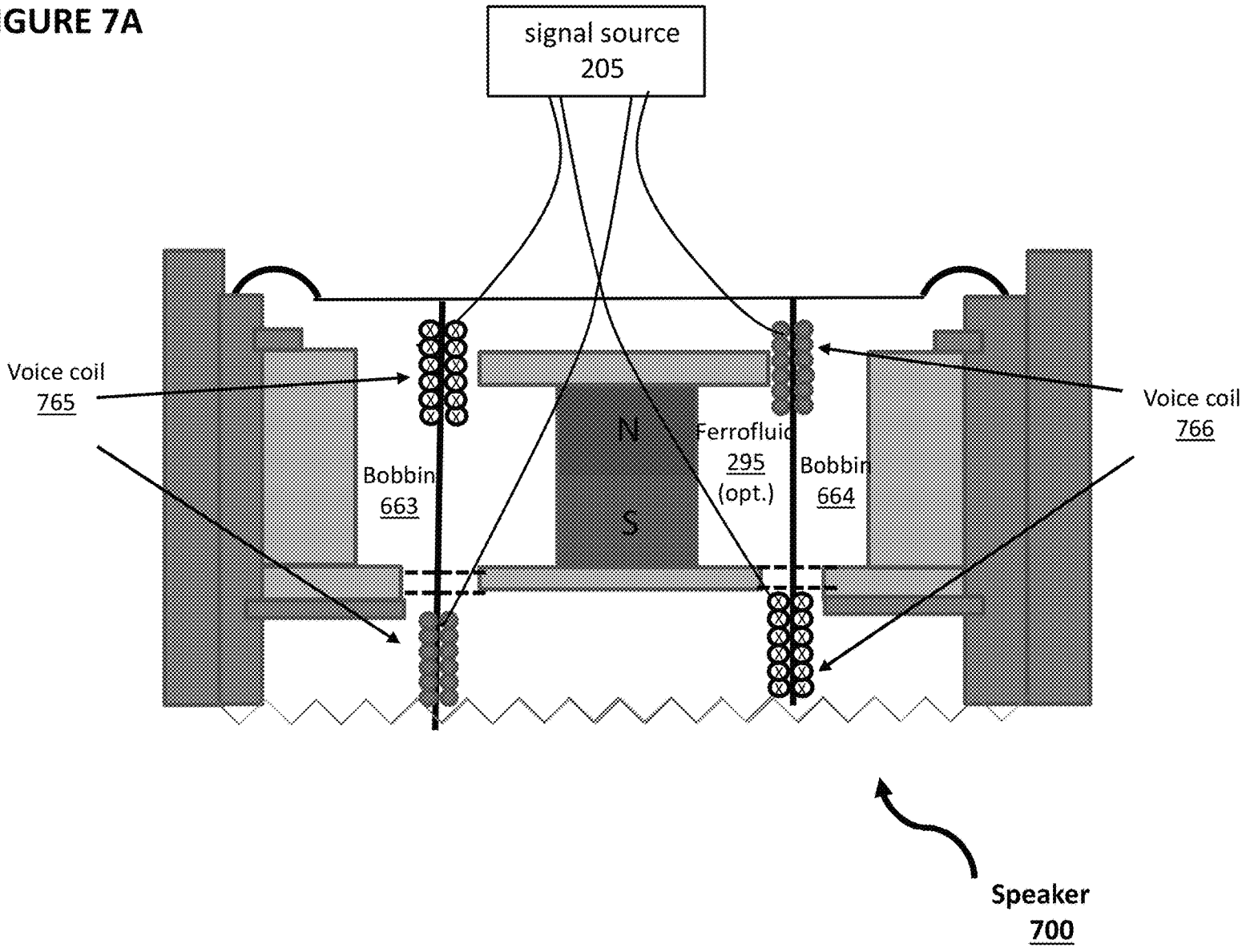
FIG. 7A depicts a side view of another embodiment of a speaker.
Figure 7B:
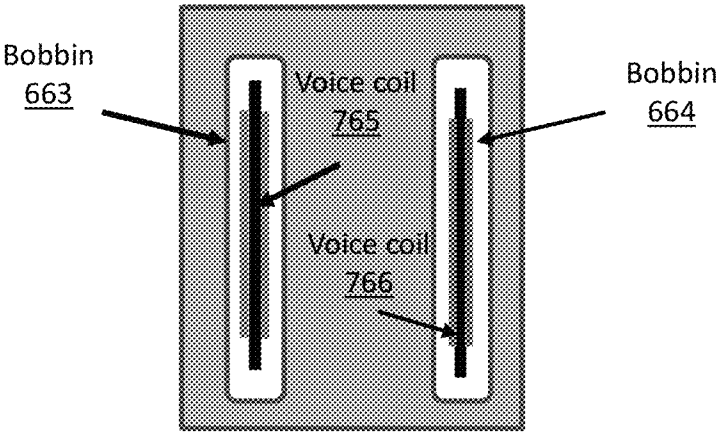
FIG. 7B depicts a top view of various components of the speaker of FIG. 7A.

FIGS. 7A and 7B depict speaker 700. Speaker 700 is identical to speaker 600 in FIGS. 6A and 6B except that voice coil 765 is wound on both sides of bobbin 663 instead of on only one side, and voice coil 766 is wound on both sides of bobbin 664 instead of only one side. Voice coil 765 and voice coil 766 are each driven, electrically out of phase, by a single signal source 205 so that current in the top of coil 765 runs in the opposite direction of the top of coil 766, and the current in the bottom of voice coil 765 runs in the opposite direction as the current in the bottom of coil 766. This provides mechanical movement of voice coils 765 and 766 in the same direction so that each coil plate can drive the diaphragm in tandem. Optionally, the gaps surrounding voice coil plates 765 and 766 are filled with ferrofluid 295.

Figure 8A:
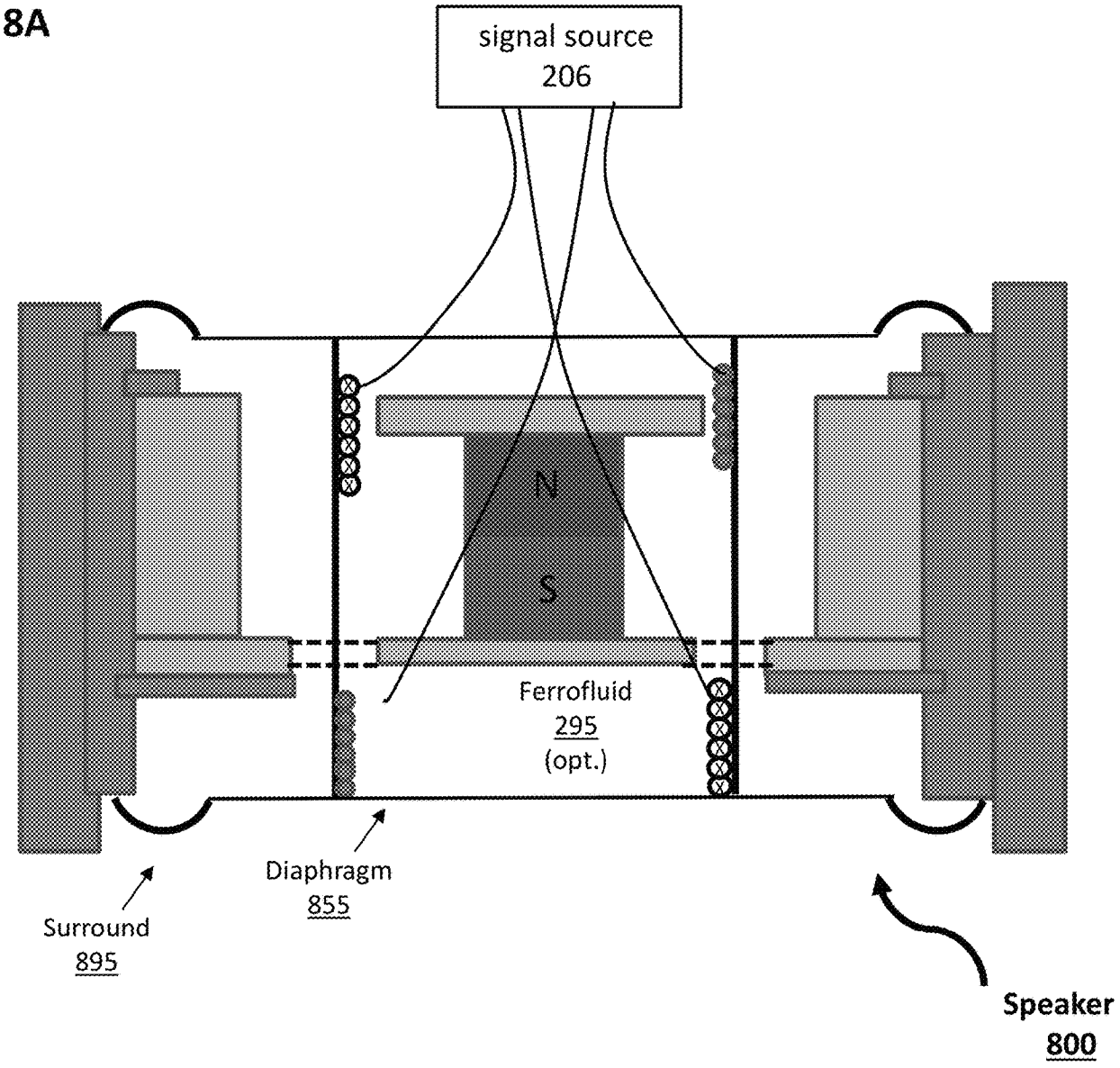
FIG. 8A depicts a side view of an embodiment of another speaker.
Figure 8B:
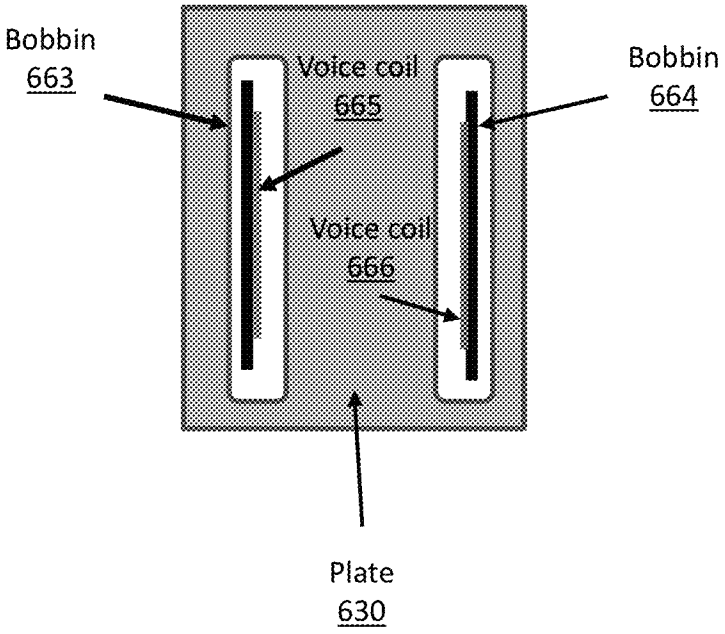
FIG. 8B depicts a top view of various components of the speaker of FIG. 8A.
Figure 9:
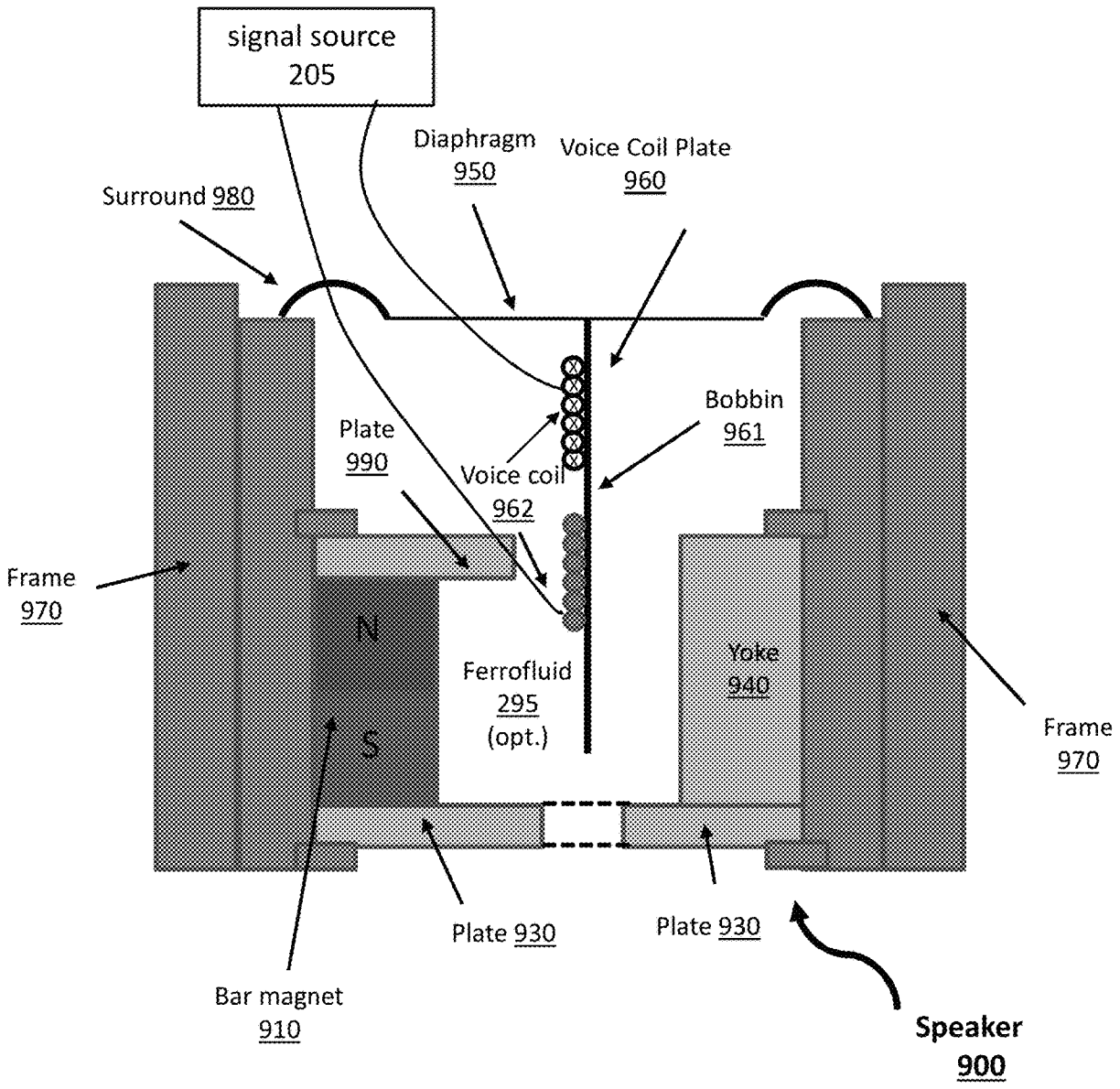
FIG. 9 depicts another embodiment of a speaker.

FIGS. 8A and 8B depict speaker 800. Speaker 800 is identical to speaker 600 in FIGS. 6A and 6B except that spider 680 is replaced with diaphragm 855 and surround 895. The Lorentz forces are generated in speaker 800 in the same manner described previously for speaker 600 with reference to FIGS. 3A-3D. Here, voice coils 765 and 766 appear on only one side of each bobbin, but a person of ordinary skill in the art will appreciate that they instead could be wound on both sides of each bobbin;

FIG. 9 depicts a side view of a speaker design utilizing a single diaphragm and a single bar magnet. Speaker 900 comprises bar magnet 910, upper plate 990, lower plate 930, yoke 940, diaphragm 950, and voice coil plate 960. Voice coil plate 960 comprises bobbin 961 and voice coil 962. Speaker 900 further comprises speaker frame 970. Bar magnet 910 has a north polarity and a south polarity. On one end, voice coil plate 960 is secured to speaker frame 970 through diaphragm 950.

Upper plate 990 is attached to the upper part of bar magnet 910, and lower plate 930 is attached to the lower part of bar magnet 910. Upper plate 990 and lower plate 930 operate in tandem with yoke 940 to contain and direct the magnetic field in the area between the magnet and the yoke where the voice coil plate 960 resides. Upper plate 990 and lower plate 930 optionally may extend beyond bar magnet 910 into the magnetic gap to increase the magnetic flux density induced in the magnetic gap.

Diaphragm 950 is positioned either above upper plate 990 or below lower plate 930. In this case, diaphragm 950 must be configured to produce the corresponding frequency range sound accordingly with the size of diaphragm 950. In this embodiment, diaphragm 950 is substantially flat. However, diaphragm 950 instead could be convex or concave, or any shape with respect to the top surface of the frame designed for any application-related acoustic design. Diaphragm 950 connects to frame 970 through surround material 980. Optionally, the gap surrounding voice coil plate 962 is filled with ferrofluid 295.

It can be appreciated that speaker 900 is similar in design to speaker 200, except that the voice coil plate 960 is located further above the magnetic area generated by bar magnet 910, such that the top half of voice coil 962 does not interact magnetically at all with the magnetic area formed by bar magnet 910, yoke 940, and plates 990 and 930. That is, all movement of voice coil plate 960 is caused by the magnetic forces acting upon the lower portion of voice coil 962.

In all embodiments of the speaker, each voice coil may be comprised of any electrically-conductive material, including but not limited to, any variant of copper wire, printed circuit board, flexible printed circuit board, or other conductive metal or alloy.

In all embodiments of the speaker, electric audio signals from one or more signal sources is translated into kinetic energy to move one or more diaphragms, reproducing sound.

According to the examples discussed before, unlike traditional speakers such as speaker 100, it is possible to realize rectangular shaped, flat speakers instead of circular speakers, to simplify parts holding the voice coil plate and multiple diaphragms, to play multi-frequency range sounds at the same time by varying the sizes of diaphragms, and to play a wide range of sounds in general. In addition, the embodiments utilize only a single bar magnet, which substantially reduces the manufacturing costs of the embodiments, as bar magnets are relatively expensive components.

The embodiments allow speakers to be ultra-light and ultra-thin which perfectly aligns with the demands for speakers used in thin and light objects. By using only one bar magnet instead of more than one bar magnet for this bar magnet style speaker with a flat voice coil, the embodiments have a significantly reduced manufacturing cost compared to traditional speakers.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements, and procedures which, although not explicitly shown or described herein, embody the principles of the disclosure and can be thus within the spirit and scope of the disclosure. Various different exemplary embodiments can be used together with one another, as well as interchangeably therewith, as should be understood by those having ordinary skill in the art. In addition, certain terms used in the present disclosure, including the specification, drawings and claims thereof, can be used synonymously in certain instances, including, but not limited to, for example, data and information. It should be understood that, while these words, and/or other words that can be synonymous to one another, can be used synonymously herein, that there can be instances when such words can be intended to not be used synonymously. Further, to the extent that the prior art knowledge has not been explicitly incorporated by reference herein above, it is explicitly incorporated herein in its entirety. All publications referenced are incorporated herein by reference in their entireties.

What is claimed is:

1. A speaker comprising:

a bar magnet comprising a north pole and a south pole;

a yoke located a predefined distance from and parallel to the bar magnet, the yoke and the bar magnet separated by a gap;

a voice coil plate located between the bar magnet and the yoke, the voice coil plate comprising a coil for receiving an electrical signal; and a diaphragm on a first side of the speaker and attached to a first end of the first voice coil plate;

wherein the voice coil plate vibrates the diaphragm in response to force generated by the electrical signal in the coil and a magnetic field between the north pole and the south pole of the bar magnet.

2. The speaker of claim 1, wherein the voice coil plate further comprises a bobbin.

3. The speaker of claim 2, wherein the coil is wound on only one side of the bobbin.

4. The speaker of claim 2, wherein the coil is wound on two sides of the bobbin.

5. The speaker of claim 1, further comprising:

a spider on a second side of the speaker and attached to a second end of the voice coil plate.

6. The speaker of claim 1, further comprising:

a second diaphragm on a second side of the speaker and attached to a second end of the voice coil plate.

7. The speaker of claim 1, wherein half of the coil is outside of the magnetic field at all times during operation of the speaker.

8. The speaker of claim 1, further comprising a first plate adjacent the north pole of the bar magnet and a second plate adjacent the south pole of the bar magnet.

9. The speaker of claim 1, further comprising a frame.

10. The speaker of claim 9, wherein the diaphragm is connected to the frame by a surround material.

11. The speaker of claim 1, wherein the gap contains ferrofluid.

12. A speaker comprising:

a bar magnet comprising a north pole and a south pole;

a top plate positioned above the bar magnet;

a bottom plate positioned below the bar magnet;

a first yoke on a first side of the bar magnet, a first air gap created between the first yoke and the bar magnet;

a second yoke on a second side of the bar magnet, the second side opposite from the first side and a second air gap created between the second yoke and the bar magnet;

a first voice coil plate located in the air gap between the bar magnet and the yoke on a first side of the bar magnet, the first voice coil plate comprising a first coil for receiving an electrical signal;

a second voice coil plate located in the air gap between the bar magnet and the yoke on a second side of the bar magnet, the second side opposite the first side, the second voice coil plate comprising a second coil for receiving the electrical signal applied 180 degrees out of phase with respect to the electrical signal as applied to the first coil;

a diaphragm on a first side of the speaker and attached to a first end of the first voice coil plate and a first end of the second voice coil plate;

wherein the first voice coil plate and the second voice coil plate vibrate the diaphragm in response to a first force generated by the first electrical signal in the first coil and a magnetic field generated by the magnet and directed by the top and bottom plates and a first yoke and a second force generated by the electrical signal applied 180 degrees out of phase with respect to the electrical signal as applied to the first voice coil to the second coil and the magnetic field generated by the magnet and directed by the top and bottom plates and a second yoke.

13. The speaker of claim 12, wherein the first voice coil plate further comprises a first bobbin and the second voice coil plate further comprises a second bobbin.

14. The speaker of claim 13, wherein the first coil is wound on one side of the first bobbin and the second coil is wound on one side of the second bobbin.

15. The speaker of claim 13, wherein the first coil is wound on two sides of the first bobbin and the second coil is wound on two sides of the second bobbin.

16. The speaker of claim 12, further comprising:

a spider on a second side of the speaker and attached to a second end of the first voice coil plate and a second end of the second voice coil plate.

17. The speaker of claim 12, further comprising:

a second diaphragm on a second side of the speaker and attached to a second end of the first voice coil plate and a second end of the second voice coil plate.

18. The speaker of claim 12, wherein the same half of the coil is outside of the magnetic field of the bar magnet at all times during operation of the speaker.

19. The speaker of claim 12, further comprising a first plate adjacent the north pole of the bar magnet and a second plate adjacent the south pole of the bar magnet.

20. The speaker of claim 12, further comprising a frame.

21. The speaker of claim 20, wherein the diaphragm is connected to the frame by a surround material.

22. The speaker of claim 12, wherein the first voice coil plate and the second coil plate are surrounded by ferrofluid.

* * * * *